US005471797A

United States Patent [19]

Murphy

[11] Patent Number: 5,471,797

[45] Date of Patent: Dec. 5, 1995

[54] INFLATABLE ENCLOSURE

[76] Inventor: John K. Murphy, 27 Gowan Lane, Aurora, Ontario, Canada, L4G 4X6

[21] Appl. No.: 220,511

[22] Filed: Mar. 31, 1994

[51] Int. Cl.[6] ..... E04B 1/34

[52] U.S. Cl. ..... 52/2.17; 446/220; 472/134

[58] Field of Search ..... 52/2.17, 2.13, 52/2.22, 2.25; 472/134, 136, 137; 446/220, 267

[56] References Cited

U.S. PATENT DOCUMENTS 1,437,261 11/1922 Nagle ..... 472/134
4,335,538 6/1982 Greenberg ..... 446/220

*Primary Examiner*—Carl D. Friedman
*Assistant Examiner*—Creighton Smith
*Attorney, Agent, or Firm*—Marcelo K. Sarkis; Ivor M. Hughes; Neil H. Hughes

[57] ABSTRACT

An inflatable enclosure for amusement purposes and/or promoting physical activity comprising:

inflatable means forming a chamber when inflated, blower means for supplying air at a predetermined rate and at a predetermined pressure to inflate said inflatable means, to form a chamber, floating means located in said chamber, such that when said inflatable means is inflated by said blower means, said air supplied at a predetermined rate causes said floating means to float around in said chamber.

45 Claims, 3 Drawing Sheets

INFLATABLE ENCLOSURE

FIELD OF INVENTION

This invention relates to an inflatable structure for use as an amusement attraction, as well as promoting physical activity in children.

BACKGROUND Of THE INVENTION

In the prior art, there exists many Inflatable Structures. One such example is found in U.S. Pat. No. 3,159,165, which discloses an inflatable air-supported structure, having a door which may be made out of wood, fiberglass, or other rigid or semi-rigid material. Other examples can be found is U.S. Pat. No. 3,250,024; U.S. Pat. No. 3,335,529; U.S. Pat. No. 3,769,763; U.S. Pat. No. 3,903,659; U.S. Pat. No. 4,103,359; U.S. Pat. No. 4,164,829; U.S. Pat. No. 4,974,829; Preach patent publication No. 2,101,367; and Soviet patent publication No. 657,549. Of the above, those references purporting to teach the use of an inflatable structure for amusement purposes are: U.S. Pat. No. 4,103,369; U.S. Pat. No. 4,164,829; and French patent publication No. 2,101, 367.

The prior art teachings are limited to just that, an inflatable structure, for which can be used for amusement purposes. Nowhere within the prior art, is there shown, as far as applicant is aware, an inflatable structure which will not only amuse children, but also allow children to become physically active, by chasing, for example, floating balloons or the like within the inflatable structure. Accordingly, it is an object of the present invention to provide an inflatable enclosure, for use as not only an amusement device for children, but also as a physical activity promoter as well.

Yet still another object of the invention is to provide an inflatable enclosure which has ventilation means to regulate the pressure and quality of air therein.

It is still another object of the invention to provide a method of amusing and promoting physical activity (i.e., cardiovascular, muscular, etc.), and teaching children hand-eye, foot-eye coordination, within an inflatable enclosure having a plurality of floating or moving objects in the enclosure, which the children can chase.

It is yet another object of the invention to provide an inflatable enclosure inflated by a blower or the like. A further object of the invention is to provide an inflatable enclosure which has an entrance and exit area that minimizes pressure loss and air loss in the enclosure, when entering and/or exiting the enclosure.

Further and other objects of this invention will become apparent to a person skilled in the art from the following summary of the invention and the more detailed description of the preferred embodiments illustrated herein.

SUMMARY OF THE INVENTION

According to one aspect of the invention, there is provided an inflatable enclosure for amusement purposes and/or promoting physical activity comprising:

inflatable means forming a chamber when inflated, preferably having an interior, exterior, wall, floor and ceiling, blower means for supplying air at a predetermined rate and at a predetermined pressure to inflate said inflatable means, to form a chamber, floating means preferably an inflated balloon or a plurality of inflated balloons, located in said chamber, such that when said inflatable means is inflated by said blower means, said air supplied at a predetermined rate causes said floating means to float around in said chamber.

In a preferred embodiment, said inflatable enclosure further comprises at least one vent means disposed at a predetermined position to provide venting of said air in said chamber at a predetermined rate, preferably said vent means comprises a plurality of vent apertures disposed at predetermined positions on said inflatable means.

In another embodiment, said inflatable enclosure further comprises entrance/exit means, preferably comprising at least two panels overlapping each other, releasably attached together, such that when the panels are opened to allow entrance into or exit out of said inflatable enclosure, a minimal loss of air is experienced.

In yet still another embodiment, said inflatable means further comprises at least one substantially transparent portion.

Yet still another embodiment, said inflatable enclosure comprises blower aperture means disposed on said inflatable means at a predetermined position for the connection of said blower means to said inflatable means.

In yet another embodiment, said chamber is further comprised of a plurality of interconnected panels and a least one floor panel and one ceiling panel, said panels being made of a substantially nylon-type material or the like.

In yet another embodiment, said inflatable enclosure further comprises restraining means to minimize movement of said enclosure, said restraining means preferably is integral with said inflatable means.

In yet still another embodiment, there is provided an inflatable enclosure for amusement purposes and promoting physical activity comprising:

inflatable means being formed of a plurality of interconnected panels of an inflatable material, taking the form of a chamber, when inflated, said chamber having, an interior, exterior, side walls, front wall, back wall, a floor, and a ceiling, whereon at least on one panel thereof, there is a window of transparent material, blower means for supplying air at a predetermined rate and pressure to said inflatable means, blower aperture means disposed on one of said interconnected panels forming one of said side wall, to allow said blower means to be in contact with said inflatable means, at least one vent means located on each of said panels forming the side walls and the front walls, to provide venting of said air in said chamber at a predetermined rate not causing substantial underinflation and/or overinflation.

at least one floating means disposed in the interior of said chamber, such that said air supplied by said blower means to inflate said inflatable means also causes said at least one floating means to float around the interior of said chamber, entrance/exit means disposed on said chamber, to allow entering into and exiting out of said chamber when inflated while maintaining said chamber inflated, and restraint means to minimize unwanted movement of said inflatable means when inflated.

In a preferred embodiment, said floating means comprises a plurality of inflated balloons.

In yet another embodiment, there is provided for use in amusing and promoting physical activity in children, an inflatable enclosure comprising:

inflatable means forming a chamber having an interior, an exterior, a wall, a floor, and a ceiling, when inflated, said chamber when inflated being of a size suitable for allowing at least one child to walk or run around said interior thereof, blower means for supplying air at a predetermined rate and at a predetermined pressure to inflate said inflatable means, to form a chamber, said blower means being connected to said inflatable means, blower aperture means allowing for the connection of said blower means to said inflatable means, said blower aperture means being located on said inflatable means at a predetermined position, at least one vent means situated at a predetermined position on said inflatable means, to provide venting of said air within said interior of said chamber at a predetermined rate, entrance/exit means located at a predetermined position on said wall of said chamber of said inflatable means, floating means located in said interior of said chamber, such that when said inflatable means is inflated by said blower means, said air supplied at a predetermined rate causes said floating means to float around the interior of said chamber.

According to yet another embodiment, there is provided a method of amusing and promoting physical activity in children, comprising placing children into an inflatable enclosure, said enclosure comprising:

inflatable means forming a chamber when inflated, blower means for supplying air at a predetermined rate and at a predetermined pressure to inflate said inflatable means, to form a chamber, floating means located in said chamber, such that when said inflatable means is inflated by said blower means, said air supplied at a predetermined rate causes said floating means to float around in said chamber, such that said children chase after the floating means promoting cardiovascular and/or muscular activity or the like.

In a preferred embodiment, said inflatable means further comprises at least one vent means disposed at a predetermined position to provide venting of said air in said chamber at a predetermined rate.

Preferably, said vent means comprises a plurality of vent apertures disposed at predetermined positions on said inflatable means.

In a preferred embodiment, said chamber further comprises entrance/exit means.

In yet still another preferred, said chamber further comprises at least one substantially transparent portion.

Preferably, said inflatable means further comprises blower aperture means disposed on said inflatable means at a predetermined position for the connection of said blower means to said inflatable means.

Preferably, said entrance/exit means further comprises at least two panels overlapping each other, releasably attached together, such that when the panels are opened to allow entrance into or exit out of said inflatable enclosure, a minimal loss of air is permitted.

Preferably, said chamber further comprises an interior, exterior, wall, floor and ceiling.

Preferably, said inflatable means is formed of a nylon-type material.

Preferably, said chamber is substantially spherical in shape, and preferably, said chamber is of a fire retardant material.

Preferably, said chamber is comprised of a plurality of interconnected panels and a least one floor panel and one ceiling panel, said panels being made of a substantially nylon-type material or the like.

Preferably, said inflatable means further comprises restraining means to minimize movement of said enclosure, preferably, said restraining means is integral with said inflatable means.

Preferably, said chamber further comprises ultra-violet inhibitors, and preferably said chamber further comprises a water retardant material.

According to one aspect of the invention, there is provided an inflatable enclosure for amusement purposes comprising:

inflatable means forming a chamber having an interior, an exterior, a wall, a floor, and a ceiling, when inflated, said chamber when inflated being of a size suitable for allowing at least one child to walk or run around said interior thereof, blower means for supplying air at a predetermined rate and at a predetermined pressure to inflate said inflatable means, to form a chamber, said blower means being connected to said inflatable means, blower aperture means allowing for the connection of said blower means to said inflatable means, said blower aperture means being located on said inflatable means at a predetermined position, at least one vent means situated at a predetermined position on said inflatable means, to provide venting of said air within said interior of said chamber at a predetermined rate, floating means located in said interior of said chamber, entrance/exit means located at a predetermined position on said wall of said chamber of said inflatable means, such that when said inflatable means is inflated by said blower means, said air supplied at a predetermined rate causes said floating means to float around the interior of said chamber.

In a preferred embodiment, wherein said vent means comprises a plurality of vent apertures located at predetermined positions of said wall of said inflatable means.

In another embodiment, said chamber is substantially spherical in shape.

In yet still another embodiment, said wall further comprises at least one substantially transparent portion.

In yet still another embodiment, said entrance/exit means further comprises at least two panels overlapping each other, releasably attached together, such that when the panels are opened, to allow entrance into or exit out of said inflatable enclosure, a minimal loss of air and of pressure is experienced.

In yet still another embodiment, said inflatable means is formed of a nylon-type material.

In yet still another embodiment, said chamber is substantially dome shaped.

In yet still another embodiment, chamber is comprised of a plurality of interconnected panels made of a substantially nylon-type material or the like.

In yet still another embodiment, said chamber is of a fire retardant material.

In yet still another embodiment, said chamber further comprises ultra-violet inhibitors.

In yet still another embodiment, said chamber further comprises a water retardant material.

In yet still another embodiment, said inflatable means further comprises restraining means to minimize movement of said inflatable enclosure.

In yet still another embodiment, said floating means comprises a balloon.

In yet still another embodiment, said floating means comprises a plurality of balloons.

In yet still another embodiment, said plurality of balloons are of a plurality of colors.

According to another aspect of the invention, there is provided an inflatable enclosure for amusement purposes comprising:

inflatable means being formed of a plurality of interconnected panels of an inflatable material, taking the form of a chamber, when inflated, said chamber having, an interior, exterior, side walls, front walls, a floor, and a ceiling, wherein at least proximate one panel thereof, there is a window of transparent material, blower means for supplying air at a predetermined rate and pressure to said inflatable means, blower aperture means disposed on one of said interconnected panels forming one of said side walls, to allow said blower means to be in contact with said inflatable means, at least one vent means located on each of said panels forming the side walls and the front walls, at least one floating means disposed in the interior of said chamber, such that said air supplied by said blower means to inflate said inflatable means, also causes said at least one floating means to float around the interior of said chamber, entrance/exit means provided on one of said side wall, to allowing entering and exiting of said chamber when inflated while maintaining said chamber inflated, restraint means disposed with said inflatable means, to minimize unwanted movement of said inflatable means when inflated, said restraint means comprising a plurality of straps situated proximate the floor and proximate the ceiling of said enclosure.

According to yet another aspect of the invention, there is provided a method of amusing and promoting physical activity in children, said method comprising the use of an inflatable enclosure for amusement purposes comprising:

inflatable means forming a chamber having an interior, an exterior, a wall, a floor, and a ceiling, when inflated, said chamber when inflated being of a size suitable for allowing at least one child to walk or run around said interior thereof, blower means for supplying air at a predetermined rate and at a predetermined pressure to inflate said inflatable means, to form a chamber said blower means being connected to said inflatable means, blower aperture means allowing for the connection of said blower means to said inflatable means said blower aperture means being located on said inflatable means at a predetermined position at least one vent means situated at a predetermined position on said inflatable means, to provide venting of said air within said interior of said chamber at a predetermined rate floating means located in said interior of said chamber entrance/exit means located at a predetermined position on said wall of said chamber of said inflatable means, such that when said inflatable means is inflated by said blower means, said air supplied at a predetermined rate causes said floating means to float around the interior of said chamber, such that when the children enter the inflatable enclosure, when inflated, they can amuse themselves by chasing the floating means, whilst simultaneous engaging in physical activity by the chasing and jumping after the floating means. "Floating" throughout this application may be defined as floating, moving, circulating or the like, due to the air supplied by said blower.

BRIEF DESCRIPTION OF THE DRAWINGS

The invention will now be illustrated with respect to the following drawings illustrating embodiments of the invention in which.

DETAILED DESCRIPTION OF PREFERRED EMBODIMENTS OF THE INVENTION

Figure 1:
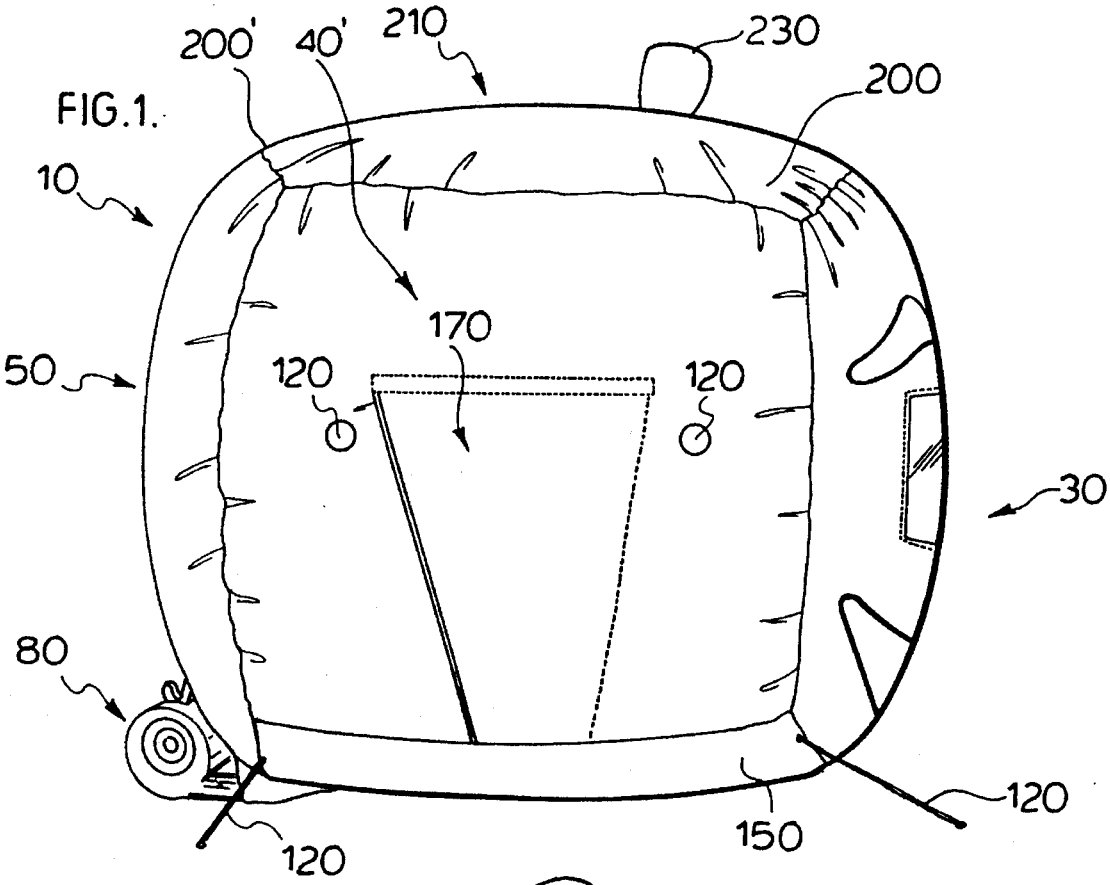
FIG. 1 is a side elevation view of the present invention when inflated in a preferred embodiment.
Figure 2:
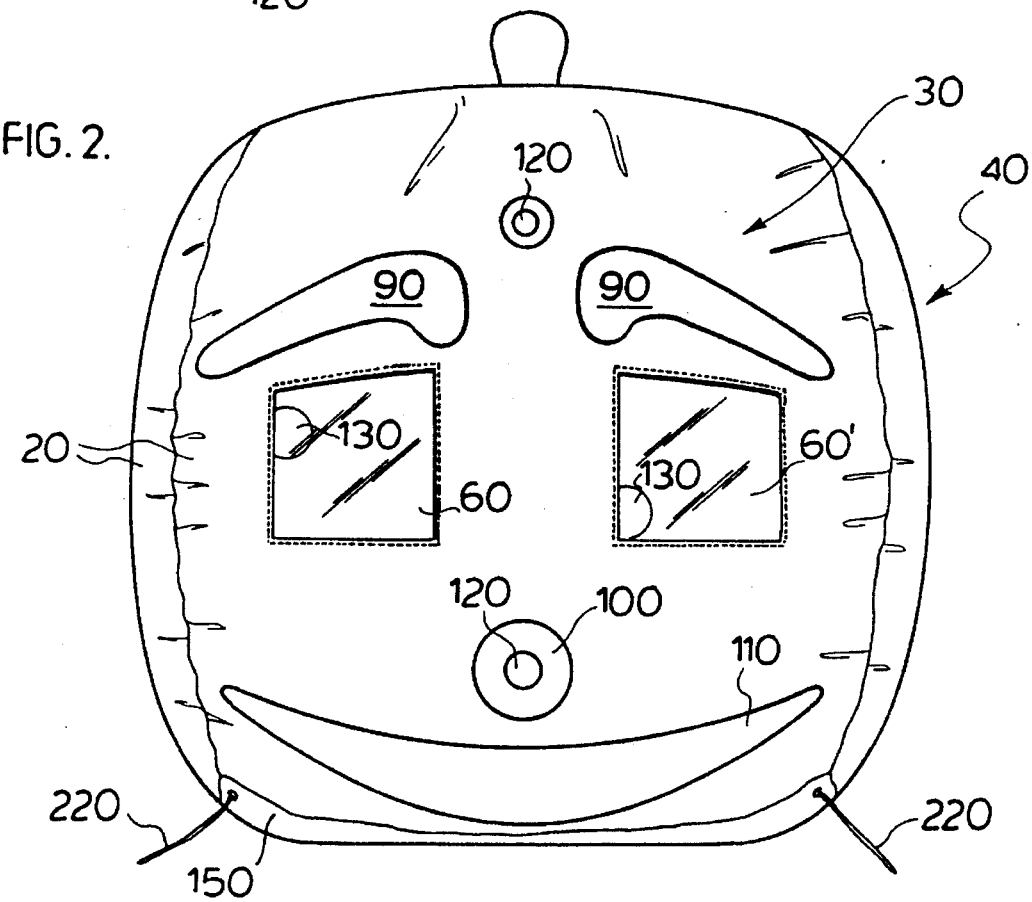
FIG. 2 is a front elevation view of the present invention when inflated in a preferred embodiment.
Figure 3:
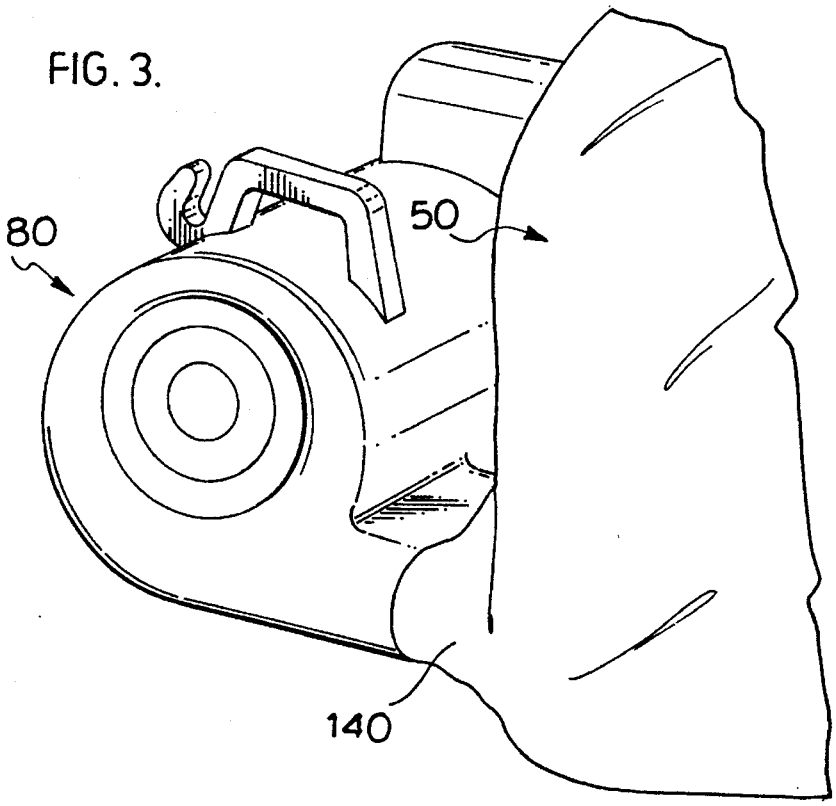
FIG. 3 is an exploded view of the blower connected to the inflatable enclosure in a preferred embodiment.
Figure 4:
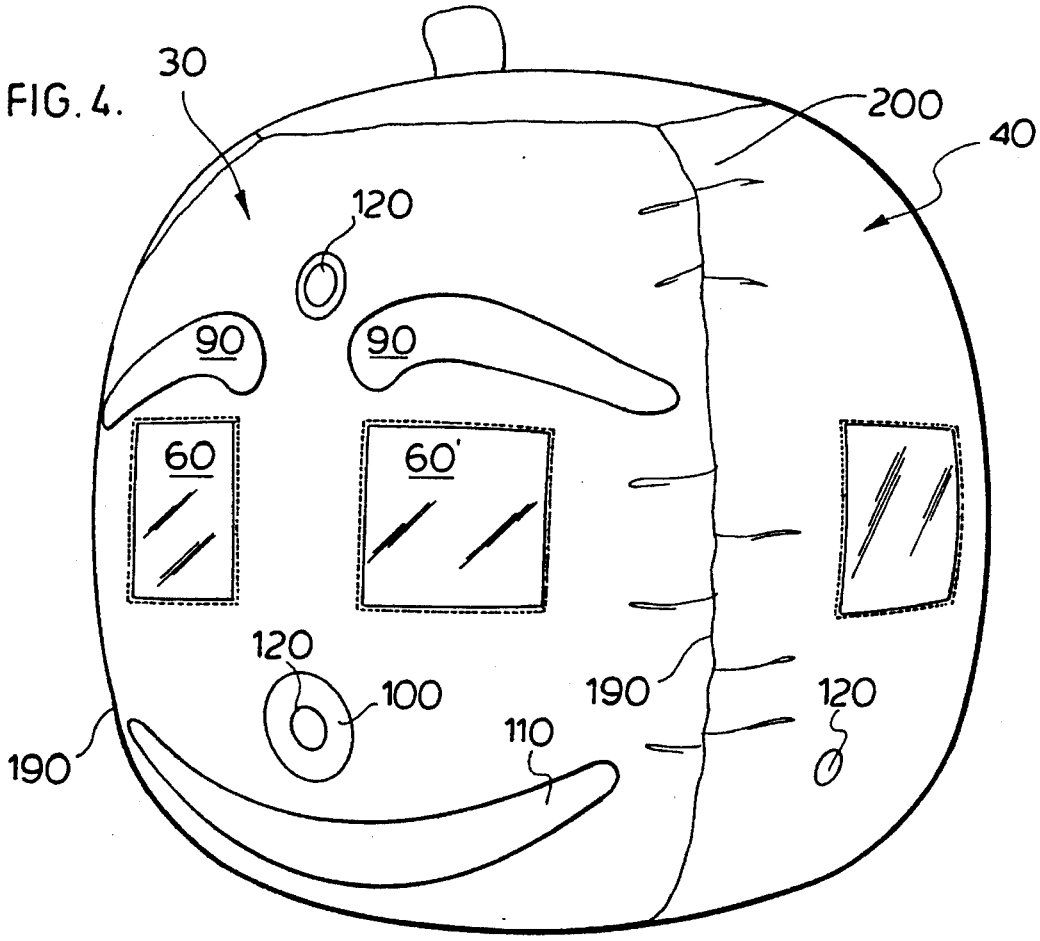
FIG. 4 is a perspective view of the present invention in a preferred embodiment.
Figure 5:
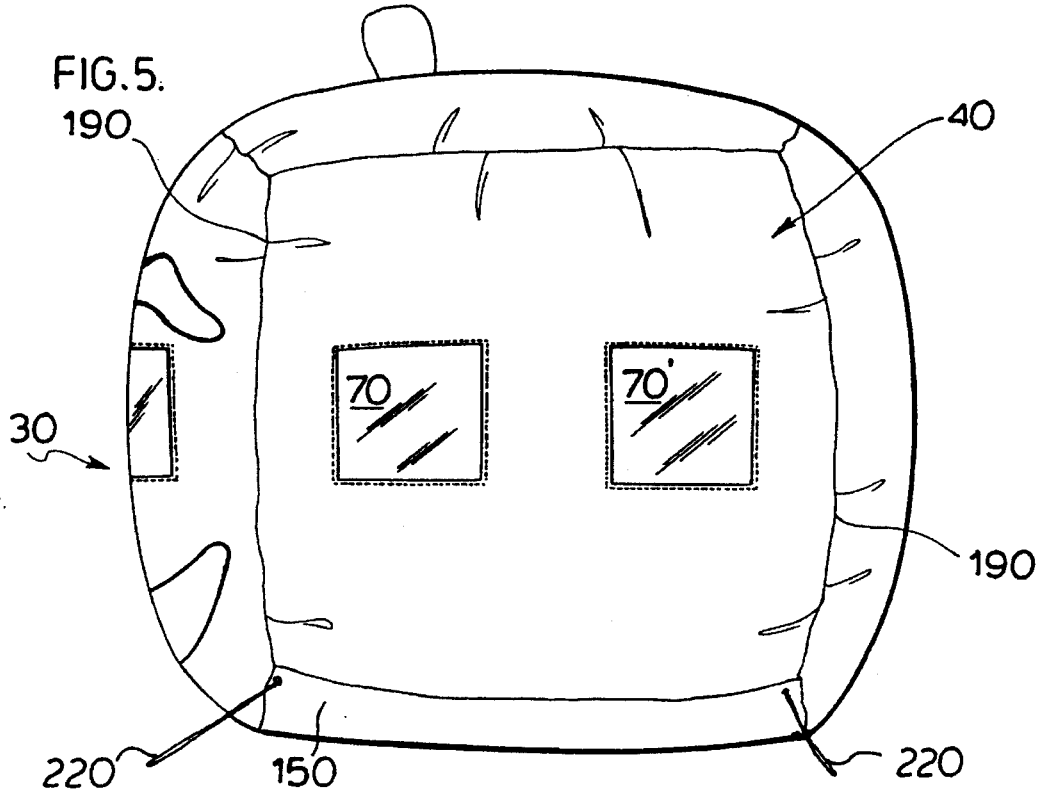
FIG. 5 is a side elevation view.
Figure 6:
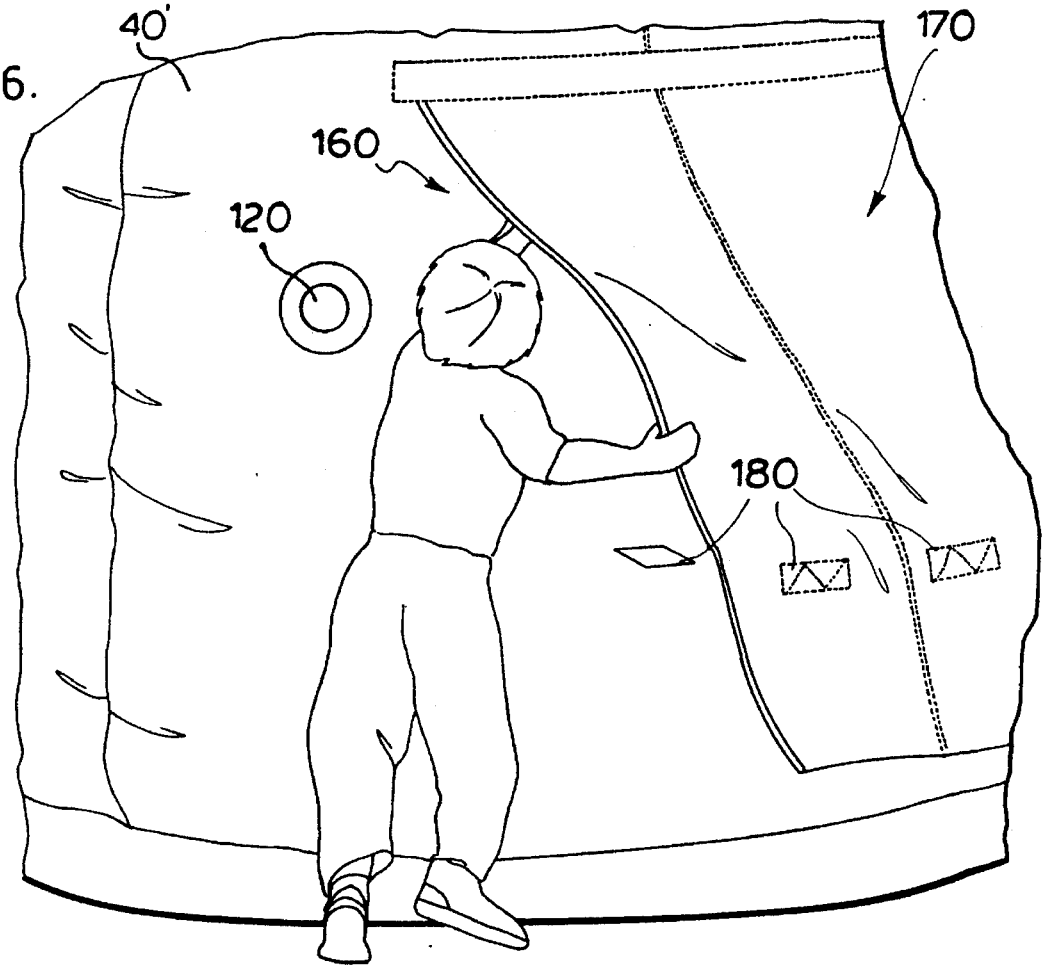
FIG. 6 is a side view showing a person entering the present invention in a preferred embodiment.

Referring now to the Figures, there is provided (which is kept inflated by the blower 80) the inflatable enclosure 10 substantially spherical in shape, made up of a plurality of interconnected panels 20, forming a front 30, sides 40 40' and back 50. On the front 30 thereof, there are two transparent sections 60, 60', as well as on one side 40, there are two transparent sections 70, 70', substantially square in shape. These transparent sections 60, 60', 70, and 70' are provided primarily for the supervision of any occupants within the inflatable enclosure 10.

In a preferred embodiment, the front 30 of the inflatable enclosure 10 has a happy face design thereof formed of two eyebrows 90, a nose 100, and a smiling mouth 110, in order to attract people, like children to the inflatable enclosure 10. Located at predetermined positions on the interconnected panels 20, are a plurality of vent means 120 in order to regulate the pressure in the inflatable enclosure 10.

Floating means, in this instance, a plurality of balloons 130 are provided in the inflatable enclosure 10 due to the air currents produced by the blower 80 blowing air into the inflatable enclosure 10. The blower 80 in this instance is a domestic carpet blower, such as the WB3 Model, manufactured by Windsor Industries, Inc., which can produce up to 3000 cfm (84 $m^3$/min.) air movement. The vent means 120 are preferably designed in this preferred embodiment for 3000 cfm of air movement. The blower 80 is preferably attached to the inflatable enclosure 10 by means of an aperture 140 disposed at a predetermined position on the inflatable enclosure 10, which will not hamper the movement of the balloons 130 in the inflatable enclosure 10, and will not be a safety hazard to the occupants in the inflatable enclosure 10. In this instance, the aperture 140 is located on the back 50 proximate the floor 150, of the inflatable enclosure 10. The blower 80 may be attached to the aperture 140 by any suitable means, in this instance, in the preferred embodiment, the aperture 140 and blower 80 are attached to each other via Velcro™ strips attached to both the blower 80 and the aperture 140, providing a good seal to prevent any unwanted air pressure loss within the inflatable enclosure 10.

On one side 70 of the inflatable enclosure 10, there is provided entrance/exit means 160, which is in the preferred embodiment, preferably two overlapping panels 170, 170' being releasably interconnected by appropriate means, suitable for ease of operation by an operator of the inflatable enclosure 10, to allow ease of entry and exit of occupants, i.e., children, into and out of the inflatable enclosure 10, in this instance, the two overlapping panels 170, 170' substantially trapezoid in shape are interconnected by Velcro™ strips 180 which can be easily opened and closed by the operator of the inflatable enclosure 10, and also minimizes the air loss when opening said overlying panels 170, 170'.

The panels 20 are preferably made of nylon material preferably 210 denai nylon material, and are interconnected preferably by a lap seam stitch pattern using any appropriate thread, some examples being a nylon 26 thread, an M-25 polycotton thread, or a CSV-69 polycotton thread.

The nylon material is preferably treated with a suitable fire retardant, one example is Fyrex, and also the nylon material is preferably treated with at least one U.V. inhibitor, for safety reasons and also retardization of degradation of the material.

In a preferred embodiment, the floor 150 is made of a 420 denai grade nylon material, since the occupants will be walking and jumping on the floor 150, and the floor 150 must be able to tolerate such conditions.

In order to keep the inflatable enclosure 10 from moving around when the occupants therein are moving around inside the inflatable enclosure 10, there is provided restraint means, in this instance, in a preferred embodiment, roof tie down polypropylene straps 190, 190' which are each fed through sleeves 200, 200' located proximate the top 210 of the inflatable enclosure 10. The sleeves 200, 200' are arranged preferably in an "X" array. Proximate the floor 150 of the inflatable enclosure 10, there is a resilient restraint means, in this instance, shock cords 220, having two ends 220', one of said two ends 220' is attached to the inflatable enclosure 10 and the other of said two ends 220' two ends is secured to the floor or the ground, depending on the situation, together with the shock cords 220. In a preferred embodiment, the vent means 120, in this instance substantially circular holes, are reinforced by a hem such that if children or the like put their hands through the holes, they will not damage the panels 20.

In setting up the inflatable enclosure 10, said inflatable enclosure 10 initially is deflated and rolled up (not shown). The operator would unroll the inflatable enclosure 10, ensuring the floor 150 is side down, and also would arrange the inflatable enclosure 10 so that the entrance/exit means 160 is where the operator wants it to be. The operator would then locate the blower aperture 140 and attach the blower 80 to same via the Velcro™ strips, and ensure a good connection. Ensure the polypropylene straps 190, 190' are each fed through the sleeves 200, 200' respectively in order to tie same down after said inflatable enclosure 10 is fully inflated.

Now, turn the blower 80 on high at 3000 cfm for a large unit, (i.e., 12'×12'), and on low at 2000 cfm–2500 cfm for a smaller unit (i.e., 8'×8') and allow the inflatable enclosure 10 to fully inflate. Then tie down each end of the polypropylene straps 190, 190' to the floor or ground with appropriate means (i.e., stakes if on grass, or sandbags on pavement) preferable at least 3 feet away from the unit, tie the inflatable enclosure 10 down such that the floor 150 is substantially flat to the ground, using the straps 190, 190' and the shock cords 220. If outside, and the winds are medium, two small weights (i.e., sandbags) may be placed on the windward side inside of the inflatable enclosure 10, proximate the floor 150, to avoid the wind carrying the inflatable enclosure 10 away.

At this point, the operator may inflate from one to a plurality of balloons 130 which are preferably top quality balloons that are difficult to break since a popping balloon may frighten small children and also an easily-broken balloon may break into pieces and may be inadvertently swallowed by small children. Some examples of top quality balloons are Qualitex or Tilley balloons. Nonetheless, any broken balloons must be removed from inside the inflatable enclosure 10 immediately.

When allowing children in and out of the inflatable enclosure 10, the entrance/exit means 160 should preferably be opened slowly to allow the air pressure inside the inflatable enclosure 10 and outside to equalize. A few balloons 130 may come out when the children are entering and exiting, which only adds to the excitement when they collect them and bring them back.

The inflatable enclosure 10 when deflated and with the balloons 130 removed can be placed in a conveniently-sized carrying bag (not shown) by disconnecting the blower 80, untying the straps 190, 190' and shock cords 220, and rolling up the inflatable enclosure 10.

The inflatable enclosure 10 may be of various colors, even colors appropriate for a special season or event (e.g., orange with a green stem on top to represent a pumpkin during the fall harvest season or Halloween; green and red for the Christmas season; red to represent a tomato or apple for any season. The choice of colors is left to the imagination. Furthermore, the inflatable enclosure 10 can also have attachments, or projections, or extremities thereto, such as ears, fins, tongue, stem, leaves, noses, plates (e.g., dinosaur plates), or the like. FIG. 1 shows a stem 230 when the inflatable enclosure resembles a pumpkin.

While the foregoing provides a detailed description of a preferred embodiment of the invention, it is to be understood that this description is illustrative only of the principles of the invention and not limitative. Furthermore, as many changes can be made to the invention without departing from the scope of the invention, it is intended that all material contained herein by interpreted as illustrative of the invention and not in a limiting sense.

The embodiments of the invention in which an exclusive property or privilege is claimed are as follows:

1. An inflatable enclosure for amusement purposes and/or promoting physical activity comprising:

inflatable means forming a chamber when inflated, blower means for supplying air at a predetermined rate and at a predetermined pressure to inflate said inflatable means, to form a chamber, amusement floating means located in said chamber, such that when said inflatable means is inflated by said blower means, said air supplied at a predetermined rate causes said floating means to float around in said chamber entrance/exit means located at a predetermined position of said chamber.

2. The inflatable enclosure of claim 1, further comprising at least one vent means disposed at a predetermined position to provide venting of said air in said chamber at a predetermined rate.

3. The inflatable enclosure of claim 2, wherein said vent means comprises a plurality of vent apertures disposed at predetermined positions on said inflatable means.

4. The inflatable enclosure of claim 1, wherein said chamber further comprises at least one substantially transparent portion.

5. The inflatable enclosure of claim 1 further comprising blower aperture means disposed on said inflatable means at a predetermined position for the connection of said blower means to said inflatable means.

6. The inflatable enclosure of claim 4, wherein said entrance/exit means further comprises at least two panels overlapping each other, releasably attached together, such that when the panels are opened to allow entrance into or exit out of said inflatable enclosure, a minimal loss of air is permitted.

7. The inflatable enclosure of claim 1, wherein said chamber further comprises an interior, exterior, wall, floor and ceiling.

8. The inflatable enclosure of claim 1, wherein said inflatable means is formed of a nylon-type material.

9. The inflatable enclosure of claim 1, wherein said chamber is substantially spherical in shape.

10. The inflatable enclosure of claim 7 where said chamber is comprised of a plurality of interconnected panels and a least one floor panel and one ceiling panel, said panels being made of a substantially nylon-type material or the like.

11. The inflatable enclosure of claim 1, further comprising restraining means to minimize movement of said enclosure.

12. The inflatable enclosure of claim 11, wherein said restraining means is integral with said inflatable means.

13. The inflatable enclosure of claim 1, wherein said chamber is of a fire retardant material.

14. The inflatable enclosure of claim 13, where said chamber further comprises ultra-violet inhibitors.

15. The inflatable enclosure of claim 13 or 14, where said chamber further comprises a water retardant material.

16. The inflatable enclosure of claim 1, wherein said amusement floating means comprises an inflated balloon.

17. The inflatable enclosure of claim 16, wherein said amusement floating means comprises a plurality of inflated balloons.

18. The inflatable enclosure of claim 17, wherein said plurality of balloons are of a plurality of colors.

19. An inflatable enclosure for amusement purposes and promoting physical activity comprising:

inflatable means being formed of a plurality of interconnected panels of an inflatable material, taking the form of a chamber, when inflated, said chamber having, an interior, exterior, side walls, front wall, back wall, a floor, and a ceiling, whereon at least on one panel thereof, there is a window of transparent material, blower means for supplying air at a predetermined rate and pressure to said inflatable means, blower aperture means disposed on one of said interconnected panels forming one of said side wall, to allow said blower means to be in contact with said inflatable means, at least one vent means located on each of said panels forming the side walls and the front walls, to provide venting of said air in said chamber of predetermined rat not causing substantial underinflation and/or overinflation, at least one amusement floating means disposed in the interior of said chamber, such that said air supplied by said blower means to inflate said inflatable means also causes said at least one floating means to float around the interior of said chamber, entrance/exit means disposed on said chamber, to allow entering into and exiting out of said chamber when inflated while maintaining said chamber inflated, and restraint means to minimize unwanted movement of said inflatable means when inflated.

20. The inflatable enclosure of claim 20, wherein said amusement floating means comprises a plurality of inflated balloons.

21. The inflatable enclosure of claim 20 where said restraint means comprises a plurality of straps disposed proximate the floor and the ceiling of said enclosure.

22. For use in amusing and promoting physical activity in children, an inflatable enclosure comprising:

inflatable means forming a chamber having an interior, an exterior, a wall, a floor, and a ceiling, when inflated, said chamber when inflated being of a size suitable for allowing at least one child to walk or run around said interior thereof, blower means for supplying air at a predetermined rate and at a predetermined pressure to inflate said inflatable means, to form a chamber, said blower means being connected to said inflatable means, blower aperture means allowing for the connection of said blower means to said inflatable means, said blower aperture means being located on said inflatable means at a predetermined position, at least one vent means situated at a predetermined position on said inflatable means, to provide venting of said air within said interior of said chamber at a predetermined rate, entrance/exit means located at a predetermined position on said wall of said chamber of said inflatable means, amusement floating means located in said inferior of said chamber, such that when said inflatable means is inflated by said blower means, said air supplied at a predetermined rate causes said floating means to float around the interior of said chamber.

23. The inflatable enclosure of claim 1, 11, or 22, wherein said inflatable means further comprises an attachment, projection, extremity.

24. A method of amusing and promoting physical activity in children, comprising placing children into an inflatable enclosure, said enclosure comprising:

inflatable means forming a chamber when inflated, blower means for supplying air at a predetermined rate and at a predetermined pressure to inflate said inflatable means, to form a chamber, floating means located in said chamber, such that when said inflatable means is inflated by said blower means, said air supplied at a predetermined rate causes said floating means to float around in said chamber, such that said children chase after the floating means promoting cardiovascular and/or muscular activity.

25. The method of claim 24, wherein said inflatable means further comprises at least one vent means disposed at a predetermined position to provide venting of said air in said chamber at a predetermined rate.

26. The method of claim 24, wherein said vent means comprises a plurality of vent apertures disposed at predetermined positions on said inflatable means.

27. The method of claim 24 wherein said chamber further comprises entrance/exit means.

28. The method of claim 24, wherein said chamber further comprises at least one substantially transparent portion.

29. The method of claim 24 wherein said inflatable means further comprises blower aperture means disposed on said inflatable means at a predetermined position for the connection of said blower means to said inflatable means.

30. The method of claim 27, wherein said entrance/exit means further comprises at least two panels overlapping each other, releasably attached together, such that when the panels are opened to allow entrance into or exit out of said inflatable enclosure, a minimal loss of air is experienced.

31. The method of claim 24, wherein said chamber further comprises an interior, exterior, wall, floor and ceiling.

32. The method of claim 24, wherein said inflatable means is formed of a nylon-type material.

33. The method of claim 24, wherein said chamber is substantially spherical in shape.

34. The method of claim 31 where said chamber is comprised of a plurality of interconnected panels and a least one floor panel and one ceiling panel, said panels being made of a substantially nylon-type material or the like.

35. The method of claim 24, wherein said inflatable means further comprises restraining means to minimize movement of said enclosure.

36. The method of claim 35, wherein said restraining means is integral with said inflatable means.

37. The method of claim 24, wherein said chamber is of a fire retardant material.

38. The method of claim 37, where said chamber further comprises ultra-violet inhibitors.

39. The method of claim 37 or 38, where said chamber further comprises a water retardant material.

40. The method of claim 24, wherein said floating means comprises an inflated balloon.

41. The method of claim 40, wherein said floating means comprises a plurality of inflated balloons.

42. An inflatable enclosure for amusement purposes and/or promoting physical activity comprising:

inflatable means forming a chamber when inflated, blower means for supplying air at a predetermined rate and at a predetermined pressure to inflate said inflatable means, to form a chamber, at least one amusement object located in said chamber, said amusement objects capable of floating around in said chamber upon introduction of said air supplied at a predetermined rate to said chamber entrance/exit areas located at a predetermined position of said chamber.

43. An inflatable enclosure for amusement purposes and/or promoting physical activity comprising:

inflatable means forming a chamber when inflated, blower means for supplying air at a predetermined rate and at a predetermined pressure to inflate said inflatable means, to form a chamber, at least one amusement floating object located in said chamber, such that when said inflatable means is inflated by said blower means, said air supplied at a predetermined rate causes said amusement floating objects to float around in said chamber entrance/exit areas located at a predetermined position of said chamber.

44. The inflatable enclosure of claim 43 or 44, wherein said entrance/exit area further comprises at least two panels overlapping each other, releasably attached together, such that when the panels are opened to allow entrance into or exit out of said inflatable enclosure, a minimal loss of air is permitted.

45. An inflatable enclosure for amusement purposes and promoting physical activity comprising:

inflatable means being formed of a plurality of interconnected panels of an inflatable material, taking the form of a chamber, when inflated, said chamber having, an interior, exterior, side walls, front wall, back wall, a floor, and a ceiling, whereon at least on one panel thereof, there is a window of transparent material, blower means for supplying air at a predetermined rate and pressure to said inflatable means, blower aperture means disposed on one of said interconnected panels forming one of said side wall, to allow said blower means to be in contact with said inflatable means, at least one vent means located on each of said panels forming the side walls and the front walls, to provide venting of said air in said chamber of predetermined rate not causing substantial underinflation and/or overinflation, at least one amusement floating means disposed in the interior of said &amber, such that said air supplied by said blower means to inflate said inflatable means also causes said at least one floating means to float around the interior of said chamber, entrance/exit area disposed on said chamber, to allow entering into and exiting out of said chamber when inflated while maintaining said chamber inflated, and restraint means to minimize unwanted movement of said inflatable means when inflated.

* * * * *

UNITED STATES PATENT AND TRADEMARK OFFICE

CERTIFICATE OF CORRECTION

PATENT NO. : 5,471,797

DATED : December 5, 1995

INVENTOR(S) : John K. Murphy

It is certified that error appears in the above-identified patent and that said Letters Patent is hereby corrected as shown below:

In Claim 6 of the Patent at column 9, line 10 after 'claim' and before ', wherein' the number "4" should be changed to ---1---.

In Claim 20 of the Patent at column 10, line 5 after 'claim' and before ', wherein' the number "20" should be changed to ---19---.

In Claim 21 of the Patent at column 10, line 8 after 'claim' and before 'where' the number "20" should be changed to ---19---.

In Claim 23 of the Patent at column 10, line 37 after 'claim 1,' and before ', or 22' the number "11" should be changed to ---19---.

In Claim 42 of the Patent at column 11, line 41 after 'chamber' and before 'entrance/exit' please insert ---,---.

In Claim 42 of the Patent at column 11, line 42 at the beginning of the line, the word "areas" should be changed to ---area---.

In Claim 43 of the Patent at column 12, line 7 after 'chamber' and before 'entrance/exit' please insert ---,---.

UNITED STATES PATENT AND TRADEMARK OFFICE

CERTIFICATE OF CORRECTION

PATENT NO. : 5,471,797

DATED : December 5, 1995

INVENTOR(S) : John K. Murphy

It is certified that error appears in the above-identified patent and that said Letters Patent is hereby corrected as shown below:

In Claim 43 of the Patent at column 12, line 8 at the beginning of the line, the word "areas" should be changed to ---area---.

In Claim 44 of the Patent at column 12, line 10 after 'claim' and before ', wherein' "43 or 44" should be changed to ---42 or 43---.

Signed and Sealed this

Twenty-fifth Day of November, 1997

*Attest:*

*Attesting Officer*

BRUCE LEHMAN

*Commissioner of Patents and Trademarks*